United States Patent [19]

Ciucani

[11] Patent Number: 4,848,252

[45] Date of Patent: Jul. 18, 1989

[54] AUTOMATIC MACHINE FOR SEWING DIFFERENT KINDS OF ARTICLES, ESPECIALLY ARTICLES MADE OF LEATHER

[76] Inventor: Mario Ciucani, Via San Girolamo, Fermo (Ascoli Piceno), Italy

[21] Appl. No.: 40,568

[22] Filed: Apr. 17, 1987

[30] Foreign Application Priority Data

May 7, 1986 [IT] Italy ..... 3413 A/86

[51] Int. Cl.[4] ..... D05B 15/02; D05B 35/10; D05B 27/20

[52] U.S. Cl. ..... 112/49; 112/62; 112/63; 112/153; 112/310; 112/321; 112/136

[58] Field of Search ..... 112/28, 47, 49, 62, 112/63, 136, 153, 310, 321

[56] References Cited

U.S. PATENT DOCUMENTS

| | | | |
|---|---|---|---|
| 1,825,597 | 9/1931 | Maier et al. | 112/28 |
| 2,029,099 | 1/1936 | Gouldbourn | 112/62 |
| 2,046,933 | 7/1936 | Berger | 112/63 |
| 4,388,880 | 6/1983 | Ciucani . | |

FOREIGN PATENT DOCUMENTS

| | | |
|---|---|---|
| 599490 | 7/1934 | Fed. Rep. of Germany . |
| 583264 | 10/1924 | France . |
| 376194 | 7/1932 | United Kingdom . |

*Primary Examiner*—H. Hampton Hunter
*Attorney, Agent, or Firm*—Darby & Darby

[57] ABSTRACT

The machine includes a fixed guide that defines two longitudinal work tops, first and second work tops, which support and guide the edges of leather articles to be sewn together. A curved needle, located next to the first work top, pierce the edge located on the first work top, pass through a slot in a guide, pierce the another edge, which is being pressed onto the second work top by a pressure foot, and, finally, operates in combination with a crochet hook to produce a stitch. The needle-pressure foot assembly serves to intermittently feed the two edges while a feed dog, acting in combination with a second pressure foot located downstream of the assembly, crimps the edge situated on the first work top.

8 Claims, 5 Drawing Sheets

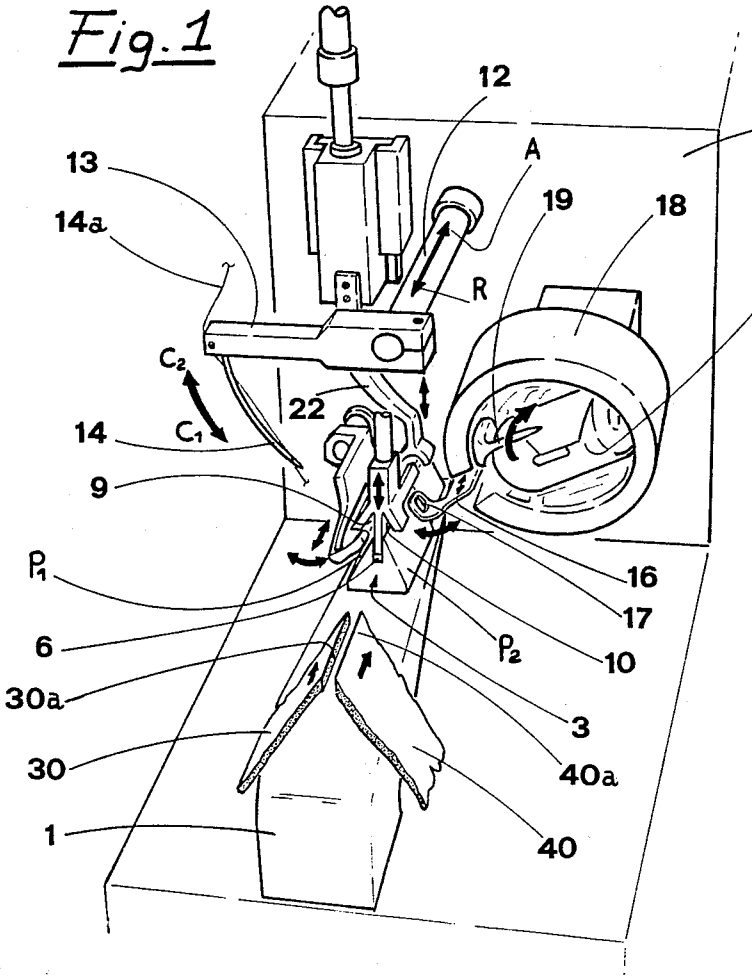
Fig. 1
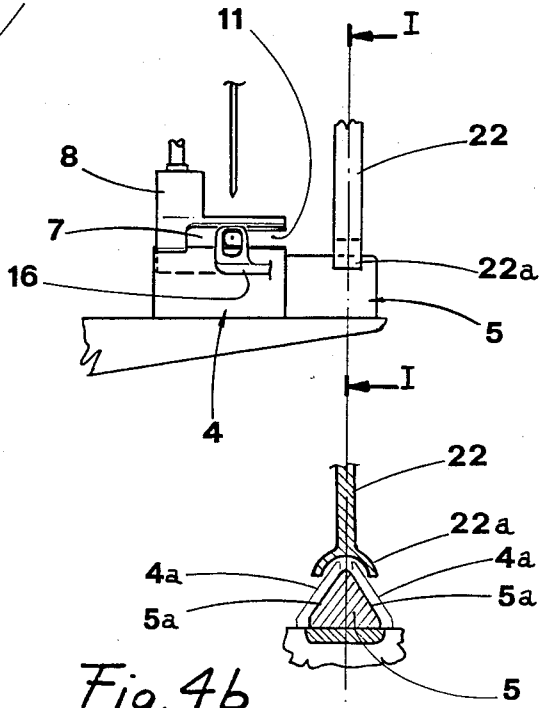
Fig. 4a
Fig. 4b

Fig. 2
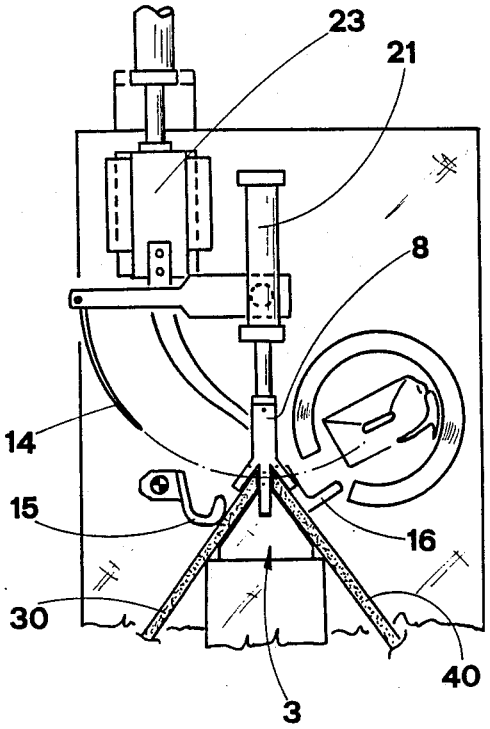
Fig. 5
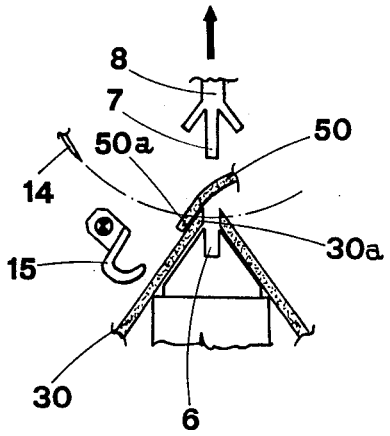
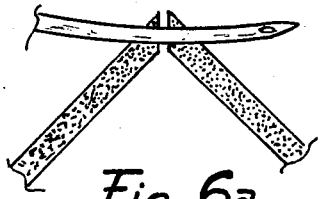
Fig. 6a
Fig. 6b
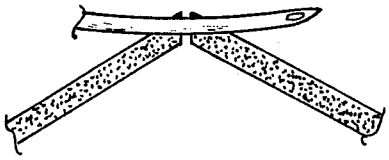
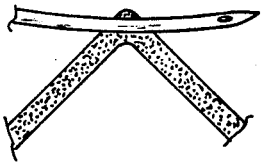
Fig. 6c
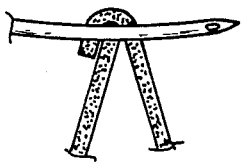
Fig. 6d 40a
30a
14
K2
P1
P2
17
I1

11
C1
7
16
I2
19
B1

15
B2
C2
I2

5
R
K1
A
I2

14a
C2
I1

28
A
K2
R
22
15
I1

AUTOMATIC MACHINE FOR SEWING DIFFERENT KINDS OF ARTICLES, ESPECIALLY ARTICLES MADE OF LEATHER

BACKGROUND OF THE INVENTION

The invention relates to an improved automatic machine for sewing different kinds of articles, especially articles made of leather.

DESCRIPTION OF THE PRIOR ART

The Applicant has already constructed machines for sewing leather, e.g. toe caps and vamps (see for example, Italian patent applications Nos: 3488/79 and 3406A/80), which correspond to U.S. Pat. No. 4,388,880 to Ciucani, which issued on June 21, 1983.

These machines consist of a vertical body equipped with a forward projecting head that houses the needle mount and the related means to control the vertical motion of the head with relation to an underlying stop arm which the leather to be sewn is laid on the, head also mounts and houses the means for driving the needle horizontally in a direction perpendicular to its own axis and parallel to the axis of the aforementioned stop arm, as well as means for mounting and driving a first pressure foot, in synchrony with the needle, with a coincident motion in the direction of feed of the leather being sewn.(see for example, '880 Patent, Column 4, lines 4 through 11).

The machines may also include a first feed dog that rests on the stop arm for moving horizontally in accordance with the translating motion of the needle, the first feed dog constitutes a moving work top an, which the edge of the leather to be sewn is laid, working in conjunction with the first pressure foot in such a manner as to hold the leather and shift it horizontally in synchrony with the horizontal motion of the needle.

The sewing machines are also equipped with a second pressure foot in conjunction with the aforementioned stop arm, to stop the leather that has already been sewn and that is being transported by the unit made up of the needle, the first pressure foot and the first feed dog.

Finally, for feeding and contemporaneously crimping the edge of a piece of leather (e.g. a vamp), the above machines are equipped with a second feed dog which rests on the first feed dog and moves horizontally in both directions parallelly and in synchrony with the first feed dog but in the opposite direction to the latter, with a third feed dog located above and hinged to the second, so that third feed dog acts against the second, the related rotary movements by which the second and third dogs grip and let go the piece of leather in synchrony with the horizontal, translating motion of the second feed dog are provided by suitable means known in the art.

In the machines described above, the head of the first feed dog has a hole for the needle to move through, at the point where the heads of the second and third feed dogs meet when they are as far forward as possible the edge of the piece of leather to be sewn (e.g. a vamp) is clamped between the feed dog heads, and is crimped when the feed dogs are in the aforementioned all-forward position because the leather that precedes it, already sewn, is locked against the arm of the second pressure foot.

In the technical set-up outlined above, as in other known machines, there is a single work top on which the two edges to be sewn together are laid; this greatly reduces the performance of the known machines because it means that the edges to be sewn must be laid over each other.

In particular, the known machines cannot be used for sewing the so-called 'decorative stitches', that is, stitches sewn on continous strips of leather, and are unable to hold the edges together unless the latter are laid over each other.

SUMMARY OF THE INVENTION

The object of this invention is to provide an automatic, universal leather sewing machine, that is, a machine designed not only to sew edges that are arranged in any way whatsoever in relation to each other, or are shaped and/or folded in any way, but also to sew seams on continuous strips of leather.

Another object of the invention is to provide a machine that can carry out automatically all the operations that could be done manually by an expert operator, and one that can do all this using a small number of parts and a simple, reliable and practical mechanical set-up.

The above objects are achieved by an improved automatic machine for sewing different kinds of articles, especially articles made of leather, the machine being characterized by the fact that it includes: a longitudinal guide that is removably mounted on an underlying fixed support and that is made up of two consecutive sections, front and rear, laterally limited by corresponding flat sloping surfaces that are mutually and upwardly convergent, and a longitudinal fin associated, at the top, to the front section, the vertical longitudinal lateral surfaces of the fin, together with the corresponding lateral sloping surfaces, make two longitudinal work tops on opposite sides, first and second work top respectively, with the said fin having on it at least part of a tranverse longitudinal slot that starts at the end of the fin that faces the rear section, stopping means are located above the fin and, in conjunction with the work tops, form longitudinal tracks, first and second track respectively, on which the edges of as many articles placed on the work tops slide in and are thus guided by the tracks, a curved needle, equipped with thread, is mounted on an arm that is equal in length to the radius of needle's curve and is keyed onto a longitudinal shaft which moves longitudinally with an outward and return stroke of preset length, the shaft oscillating in such a manner as to define the needle's lowermost and uppermost positions, the latter being maintained during the return stroke, the needle is positioned beside the first work top and operates, at least at the beginning of the outward stroke, with the slot in such a way that, during the descending phase of its motion, it pierces the edges of the articles located in the aforementioned longitudinal tracks, operating outside the aforesaid slot at the end of the outward stroke, a rotary hook device, that is associated to a bobbin of thread, is located beside the second work top, for working in conjunction with the needle to sew a stitch when the needle is in its lowermost position, a first pressure foot is located beside the second work top, moving longitudinally in synchrony with the motion of the shaft. The first pressure foot, when it is in its working position, presses the edge of the article, situated in the second track, against the second work top in accordance with the descending phase of the needle's motion, and also when it is in the working position, in conjunction with the needle in the lowermost position, with the needle disengaged from the rotary device hook shifts, the two edges of the articles one step forward, a second pressure foot operates above the rear section of the guide and moves up and down between two extreme points, being idle when it is at the uppermost point and at work when it is at the lowermost point, the lowermost point coincides with the idle, return stroke of the needle and first pressure foot assembly in such a way that the second pressure foot presses the edges, which have just been sewn together, down against the underlying rear section of the guide, a feed dog, located beside the first work top, moves longitudinally in synchrony with the needle and first pressure foot assembly but in a direction opposite to that of the latter's translating motion, having two extreme positions, a working position and an idle position, synchronized with its outward and return stroke, respectively, the feed dog operating, when it is in the working position, in conjunction with the first work top in such a manner as to feed and crimp the edge that is situated in the first longitudinal track.

BRIEF DESCRIPTION OF THE DRAWINGS

The characteristics of the invention that do not emerge from the above are highlighted hereinunder with reference to the attached set drawings, in which:

FIGS. 1 and 2 are, respectively, a view in perspective and a front view of the present machine;

FIG. 4*a* is a schematic side view of the machine, while FIG. 4*b* is a view of section I—I of FIG. 4*a;*

FIG. 5 is a schematic front view of the machine at a particular point in the sewing cycle;

FIGS. 6*a*, 6*b*, 6*c*, and 6*d* show, schematically, some examples of stitches that can be sewn with the machine in question.

DESCRIPTION OF THE PREFERRED EMBODIMENT

Figures 3A, 3B, 3C, 3D, 3E, 3F:
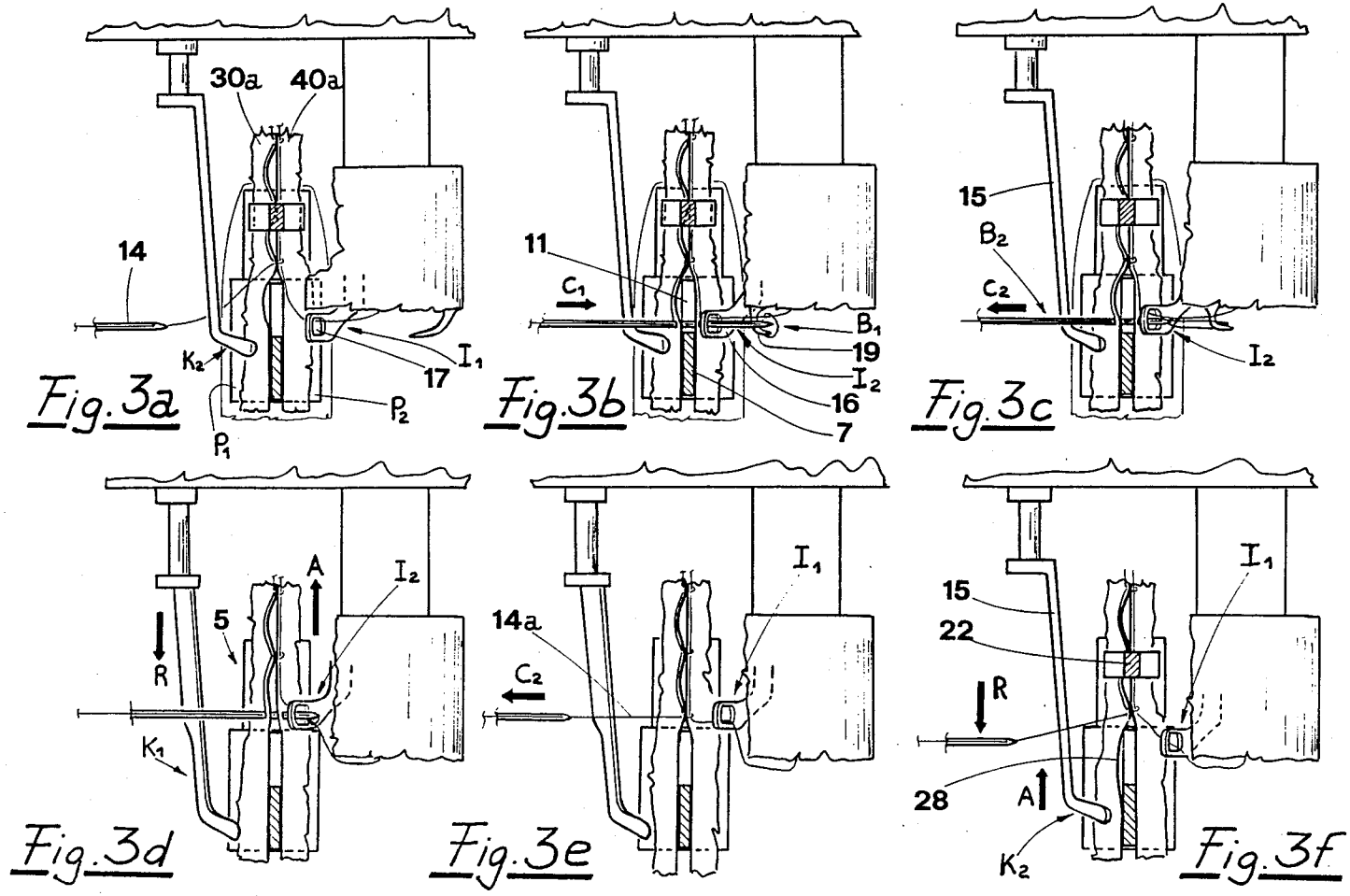
FIGS. 3*a, b, c, d, e* and *f* are schematic, enlarged views from the top of the machine at different stages in the performance of a basic sewing cycle.

With reference to the said FIGS, 1 shows a fixed support (that is an intergral part of a structure 2) on which a longitudinal guide 3 is removably mounted.

The guide (FIGS. 4*a,b*) is made up of two consecutive sections 4 and 5, front and rear, laterally limited by corresponding flat sloping surfaces 4*a* and 5*a* that are mutually and upwardly convergent; surfaces 5*a* are on the inner side in relation to surfaces 4*a*.

At the top of the front section 4, there is a longitudinal groove 6 with a fin 7 (a perfect fit in guide 3) inserted into it, in the example illustrated, is intergral with element 8 that is shaped like an upturned "V" and whose bottom facing surfaces are correspondently parallel to the surfaces 4*a* below them.

The longitudinal vertical surfaces of the fin 7, together with surfaces 4*a* of the front section 4, define two work tops P1 and P2, respectively first and second work top, which are located on opposite sides.

Element 8 is moved up and down by known means 21 and forms, in combination with the aforesaid work tops P1 and P2, two longitudinal tracks 9 and 10, first and second track respectively.

Fin 7 has a transverse slot 11 that starts on the end of the fin facing the rear section 5 and that extends longitudinally for a length which is less than the length of the fin itself; the slot might even be defined by the especially shaped design of the fin itself, in combination with the front section 4.

Above guide 3, the invention envisages a shaft 12 that is longitudinally oriented and rotatably supported by structure 2; shaft 12 is driven in known manner so that it has both translating motion, with outward strokes (in direction A) and return strokes (in direction R) of a present length, and oscillating motion in directions C1 and C2.

An arm 13 is keyed onto shaft 12, the free end of the said arm having mounted on it a curved needle 14; the curvature of the needle is identical to the arc described by the free end of the arm 13.

It should be stressed that the needle 14, when it is at the uppermost position, is on the same side as the first work top P1; at the beginning of its outward stroke, the needle operates at slot 11, whereas at the end of the same stroke, it operates outside the slot.

Beside the first work top P1 there is a first feed dog 15 that moves longitudinally in synchrony with shaft 12 but in the opposite direction to the shaft; the feed dog 15 also oscillates about a longitudinal axis between a rest position K1 (at which it is furthest from work top P1) and a working position K2 described below.

On the same side as the second work top P2, there is a first pressure foot 16 that moves longitudinally in synchrony with the translating motion of the shaft 12; the end of pressure foot 16 has a hole 17 through which needle 14 moves freely; pressure foot 16 also oscillates about a longitudinal axis between a position I1 (at which it is furthest way from work top P2) and a working position I2 described below.

Beside the first pressure foot 16, there is a support 18 attached to structure 2 which mounts (by known means) a crochet 19 that is associated (in a known manner) to a bobbin of thread 20.

22 shows a second pressure foot, whose end 22*a*, which is shaped like an upturned "U", is positioned above the rear section 5, and symmetrically about the latter's longitudinal plane of symmetry; pressure foot 22 is moved up and down by known means 23 between a raised (idle) position and a lowered (working) position that will be mentioned below.

To illustrate the operation of the machine, a basic sewing cycle, performed at any moment during its operation, will now be described.

30 and 40 show two articles of leather, whose edges 30*a* and 40*a*, as well as the strips adjacent to the latter, rest on the first and second work tops P1 and P2, respectively, and are guided by tracks 9 and 10: in this way, the aforesaid edges are always sure to be in contact along the entirety of the longitudinal surfaces of fin 7.

FIG. 3*a* illustrates the following conditions:

needle 14 (in raised position) and the first pressure foot 16 in idle position I1 (that is, when it is not exerting any pressure on edge 40*a*) are at the end of the return stroke;

feed dog 15 is at the end of its outward stroke and is also in its working position K2, that is, it is pressing the related edge 30*a* onto the corresponding first work top P1;

The second pressure foot 22 is in lowered position, that is, it is pressing the edges 30*a* and 40*a*, which have already been sewn together, onto the underlying rear section 5.

Now (FIG. 3*b*), pressure foot 16 moves to working position I2 in such a manner as to press the edge 40*a* onto the second work top P2; in synchrony with this, needle 14 moves in its descending oscillatory trajectory (direction C1) in such a manner as to pierce the edge 30*a*, pass through slot 11, pierce edge 40*a*, pass through hole 17 in pressure foot 16, and reaches its lowermost position, B1, at which it is within the working area of crochet hook 19.

A partial oscillation of the needle in direction C2 moves it outside the working area of crochet hook 19: lowered position B2 (FIG. 3*c*); this enables the crochet hook, as is known, to engage the loop made by thread 14*a* on needle 14.

FIG. 3*d* illustrates the following conditions:

the second pressure foot 22 is in raised position, that is, it is not exerting pressure on the underlying edges 30*a* and 40*a*, which have already been sewn together;

needle 14 (kept in lowered position B2) and pressure foot 16 are moving in synchrony in direction A (outward stroke);

feed dog 15 is at its idle position K1, that is, it is not exerting pressure on the underlying edge 30*a* and is moving in direction R (return stroke).

Under the conditions just described, the two edges 30*a* and 40*a* and with them, leather articles 30 and 40, are fed one step "forward" (in direction A).

The end of the outward stroke of the needle 14 and pressure foot 16 assembly, and the end of the return stroke of feed dog 15 are shown in FIG. 3*d*.

The needle now oscillates in direction C2 and thus moves to its raised position (FIG. 3*e*), pulling thread 14*a* tight in such a way as to form a stitch, in the known manner.

FIG. 3*f* illustrates the following conditions:

pressure foot 22 is once again in lowered position;

the assembly composed of needle 14 (in raised position) and pressure foot 16 (in idle position I1) is moving in its return stroke (in direction R);

feed dog 15 is at its working position K2 and is moving in its outward stroke (in direction A): as a result of the combined action of feed dog 15 and the first work top P1 below it, edge 30*a* of leather article 30 is crimped (the crimp is shown as 28).

When the return stroke of the needle and pressure foot assembly ends, which occurs at the same time as the outward stroke of feed dog 15 ends, the system is once again in the conditions illustrated in FIG. 3A and one basic sewing cycle has been completed.

Stitch spacing (length of the stroke of the needle and pressure foot assembly) can be adjusted, in known manner, by using the means that drive the said assembly; the stroke of feed dog 15 (which defines the amplitude of crimp 28) can also be adjusted in known manner, independently of the needle and pressure foot assembly, using the means for driving feed dog 15 longitudinally.

It is known that it may be necessary, at either the beginning or end of the seam, to sew the edge 50*a* of a strip 50 to edges 30*a* and 40*a*.

To carry out this particular stage of the sewing operation, element 8 must be raised so as not to interfere with the strip 50: see FIG. 5; when this happens, the element loses its guiding function since it is the operator who must "guide" edges 30*a*, 40*a* and 50*a* and keep them correctly orientated: under these conditions, there is no need for the second pressure foot 22 to operate, and so it is kept in raised position.

The following is a description, with reference to FIGS. 7 to 10, of the mechanisms which move the needle 14, the looper 19 (with a related bobbin of thread 20), the first feed dog 15, and the first pressure foot 16 in synchrony with one another.

Figure 7:
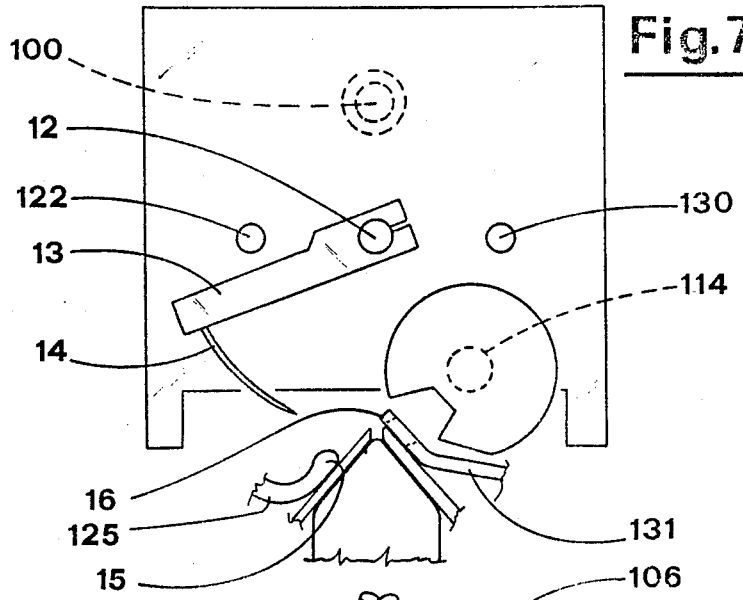
FIG. 7 is a diagrammatic front view of the machine showing in detail the mechanisms which operate the needle, the looper, the first feed dog, and the first pressure foot.
Figure 9:
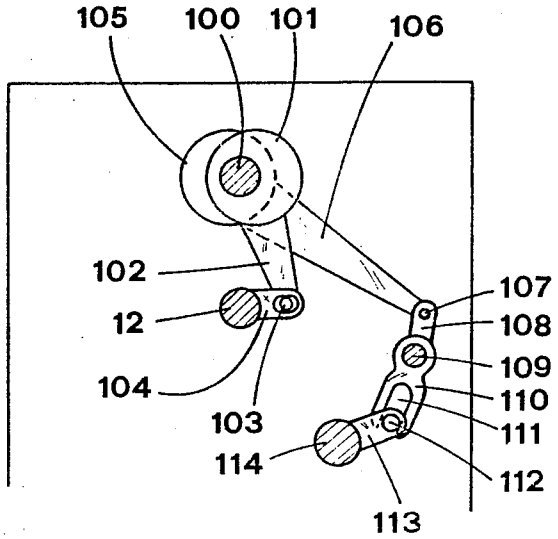
FIG. 9 is an illustration of cross section II—II in FIG. 7.

Referring to FIG 7, a primary shaft 100 is shown that is driven by known means, not illustrated, so that it rotates constantly. A first eccentric 101 is keyed to the shaft 100, and a first connecting rod 102 is mounted on this eccentric as an integral part of it, the free end 103 of this first connecting rod being hinged to an arm 104 that is keyed to the shaft 12 (FIG. 9) . The arm 13 to which the needle 14 is fitted is keyed to this latter shaft, as stated previously. The first eccentric 101-first connecting rod 102 assembly operates in conjunction with the arm 104 to make the shaft 12 oscillate, so that the needle 14 also oscillates in relation to the shaft 12 (the oscillating rotary movement of the needle 14 has been described in the specification as being in directions C1, C2).

A second eccentric 105 is keyed to the shaft 100, and a second connecting rod 106 is mounted on this eccentric as an integral part of it, the free end 107 of this second connecting rod being hinged to an arm 108 that is keyed to an intermediate shaft 109. The second eccentric 105-second connecting rod 106 assembly operates in conjunction with the arm 108 to make the intermediate shaft 109 oscillate.

A fork 110 is keyed to the intermediate shaft 109, with the fork including a throat 111. A pin 112, which is an integral part of an arm 113 which is keyed to a shaft 114 (FIG. 9) , engages in the throat 111 of the fork 110. The oscillation of the intermediate shaft 109 drives the fork 110, pin 112 and arm 113 assembly to cause the shaft 114 to oscillate. The looper 19 and bobbin of thread 20 are integral parts of the shaft 114. Consequently, the looper 19 and the bobbin 20 oscillate in synchrony with the oscillation of the needle 14.

Figure 8:
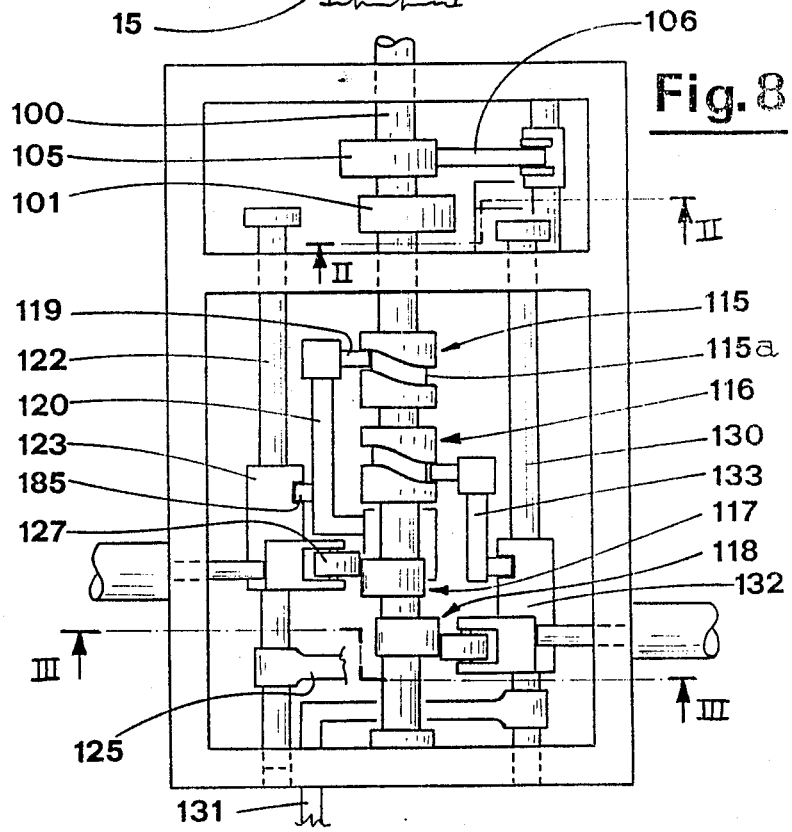
FIG. 8 shows the plan of these mechanisms.
Figure 10:
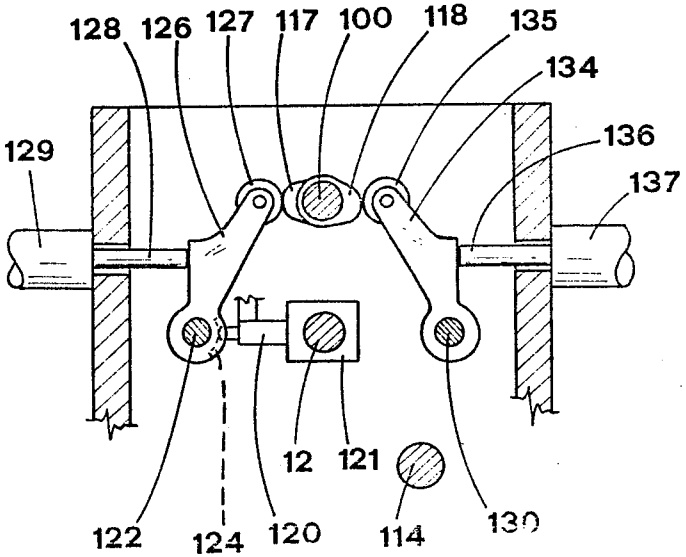
FIG. 10 is an illustration of section III—III in FIG. 7.

Two axial cams 115, 116, first and second respectively, and two radial cams 117, 118, first and second respectively, are keyed to the shaft 100 (FIG. 8) . A pin 119, which is an integral part of a first arm 120, engages in the groove 115*a* of the first axial cam 115. This arm is an integral part of a sleeve 121 that is keyed to the above-mentioned shaft 12 (FIG. 10) .

The fact that the pin 119 is engaged in the groove 115*a* means that the rotation of the shaft 100 causes the arm 120 to swing on axis (parallel to shaft 100) , thus also causing the shaft 12 to oscillate on its axis, and the needle 14 to oscillate on its axis with it. This produces the outward stroke (direction A) and return stroke (direction B) referred to previously. The needle 14 is thus moved with an oscillating rotary movement and oscillating axial translating movement, with these movements effected in synchrony with one another as well as in relation to the oscillating rotary movement of the looper 19.

A first auxiliary shaft 122 is supported by the machine in such a way that it is able to turn and move with an oscillating axial translating movement. A second arm 125, upon the end of which the said first pressure foot 16 is mounted (FIGS. 8, 10), is keyed to the shaft 122. A sleeve 123 is keyed to the first auxiliary shaft 122, with the outside of this sleeve 123 featuring a ring-shaped throat within which a projection 185, that is an integral part of the first arm 120, is inserted. As a result of this, the axial rotation of the first arm 120 causes the shaft 122 to oscillate, and the second arm 125 and related first pressure foot 16 to move with an oscillating axial movement, all in synchrony. Thus, the needle 14 and the first pressure foot 16 move with an oscillating axial movement in synchrony in the aforesaid outwards A and return B directions of movement.

The lower end of a lever 126 is keyed to the first auxiliary shaft 123, with a roller 127 fitted to the upper end of this lever in such a way that it is able to turn. A rod 128 of a pneumatic jack 129 (shown in diagrammatic form) presses elastically on the lever 126, such that the roller 127 is pressed against the first radial cam 117 (FIG. 10) . Rotation of shaft 100 causes the lever 126 to oscillate by means of the action of the first radial cam 117, this in turn causing the oscillating rotary movement of the first pressure foot 16 (in relation to the shaft 122). This is effected in appropriate synchrony with the previously described movements of the needle 14 and the looper 19. The oscillating rotary movement of the first pressure foot 16 causes the needle and looper to be moved between the idle position I1 and working position I2 referred to previously in the specification.

A second auxiliary shaft 130 is supported by the structure of the machine in such a way that it can be turned and moved along its axis, with a third arm 131, upon the end of which the first feed dog 15 is mounted, keyed to the shaft 130. A sleeve 132 is keyed to shaft 130 and subjected to the action of the second axial cam 116 by means of an arm 133. The axial oscillation (parallel to the shaft 100) of the first feed dog 15 is effected in this way. As has already been described, the first feed dog 15 moves through its outward stroke (in direction A) in synchrony with the movement of the needle 14-first pressure foot 16 assembly through its return stroke (in direction B), and vice versa.

The lower end of a lever 134 is keyed to the second auxiliary shaft 130. A roller 135 is mounted on the upper end of this lever in such a way that it is able to turn, and is kept pressed against the second radial cam 118 by means of the action of a rod 136 of a pneumatic jack 137, which presses elastically against the lever 134. The second radial cam 118 causes the second auxiliary shaft 130 to move with an oscillating rotary movement by means of the action of the lever 134. This also causes the first feed dog 15 to be moved with an oscillating rotary movement which enables the aforementioned idle position K1 and working position K2 to be obtained as described previously in the specificaion.

In short, the machine is equipped with two work tops P1 and P2; this makes it possible to orient the edges 30*a* and 40*a* in any way desired, the said orientation being defined by the slope of surfaces 4*a* in relation to each other; it is sufficient, therefore, to provide a guide 3 and a corresponding element 8 wherein the downward facing surfaces are parallel to surfaces 4*a* of the front section of the guide and the slope of surfaces 4*a* in relation to each other determines the orientation in relation to each other of the pieces of leather 30 and 40: see examples illustrated in FIGS. 6*a* and 6*b*.

With the known machines it was only possible to sew the overlaid edges supported by the same work top; the present machine, however, is universal in that it enables the edges of leather articles oriented in any way to be joined side by side; for this purpose, it is sufficient to provide a suitable number of guides 3 and elements 8; replacing a guide 3-element 8 pair does not create any difficulties.

The presence of two separate work tops makes it possible to sew "decorative seams", as illustrated by way of example in FIG. 6*c*, or to sew seams that are folded in any way, illustrated in 6*d*.

Needle 14 is subjected to less mechanical stress than the needles used in the known machines; this is because in the present machine, the two edges 30*a* and 40*a* that the needle pierces are spaced apart since the edges are resting on the longitudinal surfaces of fin 7, whereas in the known machines, the needle has to pierce both edges while these are being held tightly together.

The working parts of the machine are easily accessible to the operator, limited in number and, moreover, so laid out as to facilitate machine maintenance and/or checking operations.

In short, thanks to the presence of two separate work tops and the special arrangement of the working parts, the machine makes it possible to sew together edges that are oriented and/or folded in any way and also to sew "decorative seame"; finally, the machine is designed in such a way as to enable the edge 50*a* of a strip 50 to be sewn to edges 30*a* and 40*a* at the beginning and/or end of the seam.

It is understood that the description supplied herein is solely an unlimited example such that possible variations in the construction details will not affect the protective framework afforded to the invention as claimed hereinafter.

What is claimed is:

1. An improved machine for sewing articles, especially articles made of leather, said machine including: a longitudinal guide removably mounted on an underlying fixed support made up of front and rear consecutive sections including upwardly and inwardly flat sloping surfaces; a vertically oriented longitudinally extending fin associated with the top of said front section, the vertifcal longitudinal lateral surfaces of said fin, together with said lateral sloping surfaces of said front section, making first and second longitudinal work tops on opposite sides of said support, said fin having a transverse longitudinal slot starting at the end of said fin and extending toward said rear section; stopping means located above said fin and cooperating with the work tops to form first and second longitudinal tracks, the edges of said articles on said work tops sliding in and being guided by said tracks; a curved needle, equipped with thread, being mounted on an arm that is equal in length to the radius of said needle's value and that is keyed onto a longitudinal shaft, which moves longitudinally with an outward and return stroke of preset length and which oscillates in such a manner as to define said needle's lowermost stitching and uppermost positions, said needle being positioned beside said first work top and operating, at least at the beginning of said outward stroke, at a position corresponding to said slot in such a way that, during a descending phase of its motion, said needle pierces the edges of the articles located in the longitudinal tracks, and operating outside the slot, at the end of said outward stroke; a rotary hook device, that is associated with a bobbin of thread, said device being located beside said second work top, and timed with the needle to form a stitch when said needle is in its lowermost position; a first pressure foot located beside said second work top, that moves longitudinally in synchrony with the motion of the shaft, said first pressure foot when it is in its working position operating to press said edge of said article in said track against said second work top in timed relation to the descent of said needle, said first pressure foot cooperating, when in the working position, with the needle in said lowermost stitching position after the needle disengages from the rotary hook, to feed the two edges of said articles one stitch length forward; a second pressure foot above said rear section of said guide that reciprocates upwardly to an inoperative position and downwardly to grip said articles said gripping position of said second perssure foot being timed with the return stroke of said needle and said first preessure foot assembly whereby said second pressure foot presses the sewn edges against said underlying rear section of said guide; a feed dog, adjacent said first work top reciprocating longitudinally in synchrony with said needle and first pressure foot assembly but in a direction opposite to that of the translating motion of the first pressure foot, the outward stroke of the feed dog functioning as its working position and being inoperative on its return stroke, said feed dog operating, when in said working position, in conjunction with said first work top in such a manner as to feed and crimp said edge that is situated in the first longitudinal track.

2. A machine according to claim 1 wherein said stopping means and said fin can move up and down, in synchrony, between a lowered position which defines said longitudinal tracks and a raised position where said fin is above the front section.

3. A machine according to claim 1 wherein said stopping means consist of an upturned V shaped element, having bottom facing surfaces parallel to the corresponding flat sloping surfaces of the underlying said front section.

4. A machine according to claim 1 wherein the cross section of said rear section is similar to the cross section of said front section.

5. A machine according to claim 1 wherein said sloping flat surfaces are of smaller cross section than the corresponding sloping flat surfaces.

6. A machine according to claim 1 wherein said sloping flat surfaces are positioned symmetrically about a longitudinal plane.

7. A machine according to claim 1 wherein an end of said first pressure foot has a hole in it through which said needle passes.

8. A machine according to claim 1 wherein an end of said second pressure foot is substantially U shaped.

* * * * *